US005522599A

United States Patent [19]

Kim

[11] Patent Number: 5,522,599

[45] Date of Patent: Jun. 4, 1996

[54] SHUTTLECOCK

[76] Inventor: Sang Do Kim, 1623 Purple Sage Dr., Herndon, Va. 22070

[21] Appl. No.: 535,938

[22] Filed: Sep. 28, 1995

[51] Int. Cl.[6] ..... A63B 67/18

[52] U.S. Cl. ..... 273/417; 601/107

[58] Field of Search ..... 273/417; 601/107

[56] References Cited

U.S. PATENT DOCUMENTS

| | | | |
|---|---|---|---|
| 2,193,645 | 3/1940 | Raizen et al. | 273/417 |
| 2,360,173 | 10/1944 | Tanger | 273/417 |
| 2,484,475 | 10/1949 | Studer | 273/417 |
| 2,911,219 | 11/1959 | Arokiasamy | 273/417 |
| 3,759,518 | 9/1973 | Mroz | 273/417 |
| 3,834,705 | 9/1974 | Wong | 273/417 |
| 4,019,738 | 4/1977 | Tong | 273/417 |
| 4,082,281 | 4/1978 | Chen | 273/417 |
| 4,133,533 | 1/1979 | Doyle | 273/417 |
| 5,476,267 | 12/1995 | Gertsikov | 273/417 |

FOREIGN PATENT DOCUMENTS

| | | | |
|---|---|---|---|
| 472050 | 3/1951 | Canada | 273/417 |
| 2157580 | 10/1985 | United Kingdom | 273/417 |

*Primary Examiner*—Paul E. Shapiro

[57] ABSTRACT

A shuttlecock includes a wing member having six types of strands whose lower ends are secured to a carrier strip, and a weight member adhered to the carrier strip whereby upon striking the shuttlecock by the palm of the hand or the foot, the weight member massages various area of the hand and the foot.

10 Claims, 1 Drawing Sheet

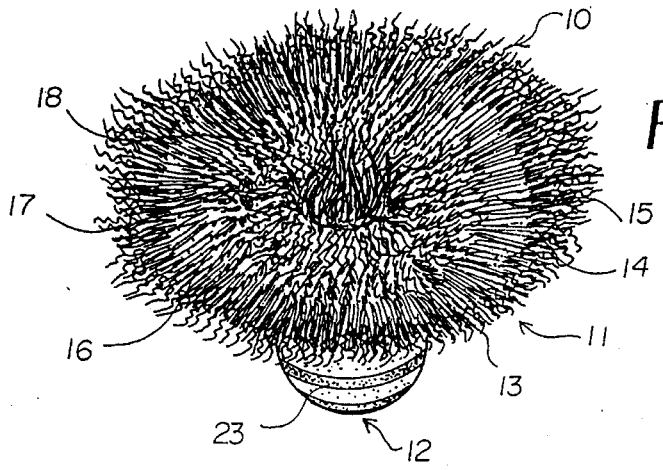
FIG. 1
FIG. 2
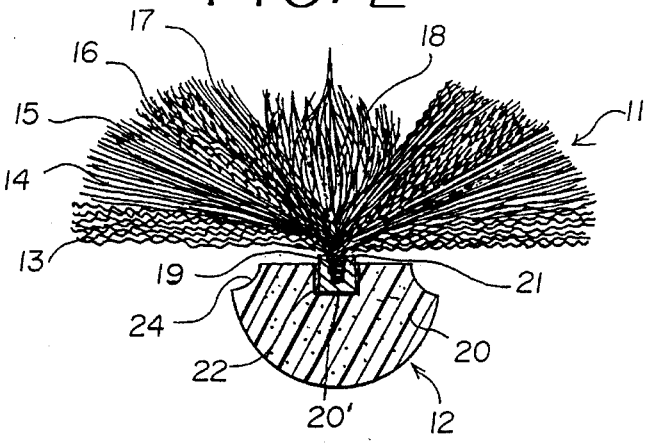
FIG. 3
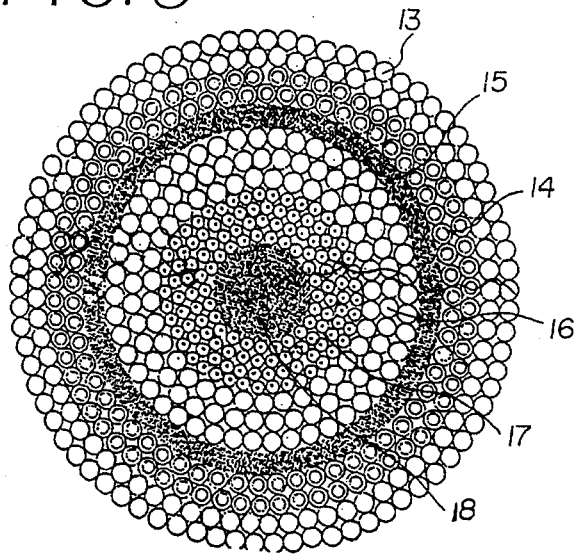
FIG. 4
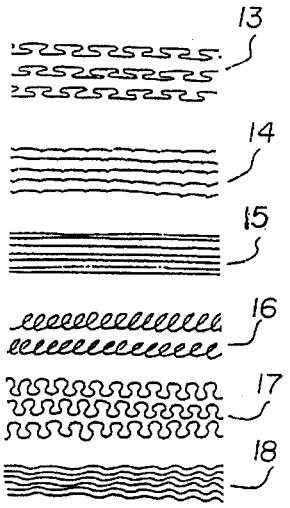

SHUTTLECOCK

BACKGROUND OF THE INVENTION

1. Field of the invention

The present invention relates to an improved shuttlecock and more particularly, to a shuttlecock including a wing member with six types of strands whose lower ends are secured to a carrier strip, and a weight member adhered to carrier strip whereby upon striking the shuttlecock by the palm of the hand or the foot, the weight member massages various area of the human palmand foot.

2. Description of Related Art

Various types of shuttlecock or bird used in playing the game of "Badminton". The shuttlecock ordinally used is provided with a vane or tail made of feathers which readily berak or turn in their sockets and therefore impair the accuracy and balance of the bird in flight after a relatively short period of use. Such shuttlecock or birds are described in U.S. Des. Pat. No. 148731, U.S. Des. Pat. No. 148733, U.S. Des. Pat. No. 259354, U.S. Des. Pat. No. 271409, U.S. Des. Pat. No. 1393407, and U.S. Pat. No. 2360173.

However, such conventional shuttlecocks are made for striking them by Badminton rackets, so that one of the human organ cannot strikes such conventional shuttlecocks go up and down very fast and whose weight member is too hard to hit by the hand or foot. Furthermore, such conventional shuttlecock cannot play indoors.

SUMMARY OF THE INVENTION

Accordingly, it is an object of the present invention is to provide an improved shuttlecock used in playing the game of the hand or the foot indoors or outdoors, which eliminates the above problems encountered with the conventional shuttlecock used inplaying the game of "Badminton".

Another object of the present invention is to provide an improved shuttlecock for the human body, which includes a wing member having six types of strands whose lower ends are secured to a carrier strip, and a weight member adhered to the carrier strip whereby upon striking the shuttlecock by the palm of the hand or the foot, the weight member of the shuttlecock massages various area of the hand or the foot so as to have brought many people relief.

A further object of the present invention is to provide an improved shutlecock which is simple in structure, inexpensive to manufacture, durable in use, and refined in appearance.

Other objects and further scope of applicability of the present invention will become apparent from the detailed description given hereinafter. It shouldbe understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to an improved shuttlecock which includes a wing member having six types of strands whose lower ends are secured to a carrier strip, and a weight member adhered to the carrier strip whereby upon striking the shuttlecock by the palm of the hand or the foot, the weight member of the shuttlecock massages various area of the hand or the foot.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of shuttlecock according to the present invention;

FIG. 2 is a sectional view of the shuttlecock according to the present invention;

FIG. 3 is an enlarged top plan view of the shuttlecock according to the present invention; and FIG. 4 is an enlarged top plan view of six types of strands of the shuttlecock according to the present invention.

DETAILED DESCRIPTION OF THE PREFERRED EMBODIMENTS

Referring now in detail to the drawings for the purpose of illustrating preferred embodiments of the present invention, the improved shuttlecock 10 as shown in FIG. 1, 2, and 3, comprises a wing member 11, a carrier strip member 19 for permitting of conveniently attaching the wing member 11 thereto by the use of conventional adhesive or its equivalent, and a weight member 12 adhered to a carrier support 21 through an adhesive 22.

As shown in FIG. 3 and 4, the wing member 11 includes first strands 13 having a flattened head or nail head shaped configuration, second strands 14 having an almost straight line configuration, third strands 15 having a straight line configuration, fourth strands 16 having a successive loop configuration, fifth strands 17 having a mushroom shaped configuration, and sixth strands 18 having a sea wave shaped configuration, respectively.

The wing member 12 includes the above mentioned various types of strands 13, 14, 15, 16, 17, and 18, and the length of the strands 13, 14, 15, 16, 17 and 18 are approximately 1.5 to 6.5 inches, preferably approximately 3.5 to 4.5 inches. The number of the strands depends on the thickness of the strands and the weight of the weight member 12. The strands 13, 14, 15, 16, 17, and 18 are made of wool, chemical fiber, optical fiber and the like.

When the shuttlecock 10 is in flight, the slipstream from the weight member 12 automatically opens up the strands 13, 14, 15, 16, 17, and 18 for forming the wing member 11 into a hollow circular wing member 11 as shown in FIG. 2. Also, the air stream passing over all strands 13, 14, 15, 16, 17, and 18 produces a balanced and accurate flight of the shuttlecock 10.

The above six strands 13, 14, 15, 16, 17, and 18 get tangled to prevent from spreading the strands by themselves, to reduce the falling speed of the shuttlecock 10, to depend on the weight of the weight member 12. When the wing member 11 spreads fully, the falling speed of the shuttlecock 10 is slow, and when the wing member 11 does not spread fully, the failing speed of the shuttlecock is fast.

The strands 13, 14, 15, 16, 17, and 18 of the wing member 11 functions as follows. The strands 13 and 14 function to spread other strands 15, 16, 17 and 18 outwardly and to prevent from contracting inwardly. The strands 15 are a thin thread for controlling the air stream therethrough so as to reduce the falling speed of the shuttlecock 10. The strands 16 are a kind of spring shaped configuration and function to control the air stream therethrough causing prevention of contraction thereof and expansion of the space. The strands 17 function to expand the space, to spread strands outwardly and to cooperate other strands. The strands 18 are a core of other strands 13, 14, 15, 16, and 17 and are a center of the weight of the shuttlecock 10.

As shown in FIG. 1 and 2, the weight member 12 includes a body 20 made of wood, rubber, sponge and the like. The body 20 has its front or striking face rounded or flattered in the usual manner for massaging to the palm of the hand and the foot when the palm of the hand or the foot strikes the shuttlecock 10 so as to have brought many people relief. The outer surface of the body 20 is provided with a kid or other conventional covering suitably secured thereto and may be provided with a band of colored, lattered, or designed materials for identification purposes.

The rear of the body 20 is formed with a groove 20' for tightly receiving the carrier support 21 with the adhessive 22 so as to a composite structure, and an annular concave portion 24 for giving air resistant to the shuttlecock 10 so as to go down slowly.

The carrier strip 19 is composed of lower ends of the strands 13, 14, 15, 16, 17, and 18 by the use of a conventional sewing thread or wire and is secured to a groove the carrier support 21 with an adhessive.

Accordingly, the shuttlecock 10 according to the present invention as shown in FIG. 1, is a kind of excercising goods, gamming goods, and massaging equipment as well as treating equipment for the human body by massaging the palm of the hand or the foot when the palm of the hand or the foot strikes it.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A shuttlecock for use in excercises or games, which comprises, a wing member composed of first strands having a flattered head shaped configuration, second strands having an almost straight line configuration, third strands having a straight line configuration, fourth strands having a successive loop configuration, fifth strands having a mushroom shaped configuration, and sixth strands having a sea wave shaped configuration, respectively, a carrier strip member for permitting of attaching to said wing member thereto, and a weight member adhered to said carrier strip, whereby upon striking the shuttlecock by the palm of the hand or the foot, the weight member hit the palm of the hand or the foot so as to massage various region of the hand or the foot and to play games.

2. The shuttlecock of the claim 1, wherein said strands are approximately 1.5 to 6.5 inches.

3. The shuttlecock of the claim 2, wherein said strands are approximately 3.5 to 4.5 inches.

4. The shuttlecock of the claim 2, wherein said strands are made of a material selected from the group consisting of wool, chemical fiber and optical fiber.

5. The shuttlecock of the claim 1, wherein said weight member includes a body member having a rounded or flattened front face and a rear face, said rear face having a rectangular groove and an annular concave portion thereof.

6. The shuttlecock of claim 5, wherein said weight member is made of a material selected from the group consisting of wood, rubber, and sponge.

7. The shuttlecock of claim 5, wherein said front face of the weight member is provided with a band of colored, lettered, or designed materials for identification purposes.

8. The shuttlecock of claim 5, wherein said carrier strip member includes a carrier support for inserting into said rectangular groove of the front face of the body of the weight member with an adhessive.

9. The shuttlecock of claim 8, wherein said carrier strip support has a rounded groove for tightly receiving a bundle of lower ends of said strands with an adhessive.

10. The shuttlecock of claim 9, wherein the lower ends of the strands are sewn together by a thread or wire.

* * * * *